US005492089A

United States Patent [19]

Hiraoka et al.

[11] Patent Number: 5,492,089

[45] Date of Patent: Feb. 20, 1996

[54] SILENCER FOR OUTBOARD MOTOR

[75] Inventors: Noriyoshi Hiraoka; Masaki Okazaki, both of Hamamatsu, Japan

[73] Assignee: Sanshin Kogyo Kabushiki Kaisha, Hamamatsu, Japan

[21] Appl. No.: 311,511

[22] Filed: Sep. 23, 1994

[30] Foreign Application Priority Data

Sep. 24, 1993 [JP] Japan ..... 5-238479

[51] Int. Cl.[6] ..... F02M 35/12

[52] U.S. Cl. ..... 123/184.47; 123/184.57

[58] Field of Search ..... 123/184.53, 184.57, 123/184.47, 195 C, 198 E

[56] References Cited

U.S. PATENT DOCUMENTS

| | | | |
|---|---|---|---|
| 2,798,470 | 2/1957 | Kickhaefer | 181/204 |
| 3,557,902 | 1/1971 | Brown | 123/198 E |
| 4,326,600 | 4/1982 | Okazaki et al. | 181/229 |
| 4,522,602 | 6/1985 | Okazaki | 123/195 C |
| 4,570,744 | 2/1986 | Hoshiba | 181/204 |
| 4,734,070 | 3/1988 | Mondek | 181/229 |
| 4,887,692 | 12/1989 | Ohtani et al. | 181/229 |
| 4,967,704 | 11/1990 | Imaeda | 123/184.23 |
| 5,035,211 | 7/1991 | Mate et al. | 123/184.31 |
| 5,277,633 | 1/1994 | Kato et al. | 123/195 P |
| 5,328,395 | 7/1994 | Oishi | 123/195 P |

*Primary Examiner*—David A. Okonsky
*Attorney, Agent, or Firm*—Knobbe, Martens, Olson & Bear

[57] ABSTRACT

A protective cowling and air silencing device for the power head of a watercraft propulsion unit. The cowling is provided with an atmospheric air inlet opening, and a duct is provided internally in the cowling for assisting in water separation by directing the inlet air downwardly toward a drain opening. The engine is provided with charge formers that have an air silencing device that is provided with at least one resonating chamber on the side of the charge former and which communicates with a delivery passage of the device through a tuning neck for silencing purposes.

17 Claims, 8 Drawing Sheets

SILENCER FOR OUTBOARD MOTOR

BACKGROUND OF THE INVENTION

This invention relates to a silencer for an outboard motor, and more particularly to an improved silencing and air delivery device for a marine propulsion engine.

As is known, marine propulsion engines generally must be extremely compact in nature. This is particularly true with respect to the power head of an outboard motor wherein the engine is contained within a protective cowling. The induction air for the engine is delivered through an opening in the protective cowling, and this opening is generally configured so as to exclude as much water as possible from the air introduced to the interior of the protective cowling. The air is then delivered from the interior of the protective cowling to the charge formers of the engine for engine operation.

It is well known that the induction system air is one of the large sources of potential engine noise. Of course, if a large plenum chamber supplies air to the induction system, then silencing can be achieved. However, it is difficult with the compact nature of outboard motor power heads to employ such large plenum chambers.

The problems attendant with prior art constructions can be best understood by reference to FIGS. 1 and 2, which are respective side and top elevational views of the power head of a conventional outboard motor with the protective cowling being shown in cross section in FIG. 1 and with the main cowling member removed in FIG. 2. The power head is identified generally by the reference numeral 11, and it can be associated with any type of propulsion unit, such as a propeller or the like, which are driven in well-known manners. The power head 11 is comprised of an internal combustion engine 12 and a surrounding protective cowling that is comprised of a lower tray portion 13 and an upper main cowling portion 14.

The upper main cowling portion 14 is, as is typical with conventional outboard motor practice, provided with a rearwardly facing air inlet opening 15 through which atmospheric air may be delivered. This opening feeds a cavity 16 formed by the main cowling member 14 and a cover piece 17 thereof. A vertically extending air inlet duct 18 extends through a lower wall 19 of the main cowling member 14 and permits air to be introduced into the area around the engine 12, as shown by the arrows in this figure. The configuration of the cowling inlet device described is designed to promote water separation.

The engine 12 may be of any type that is well known in this art and in the illustrated embodiment as being depicted as a V-6, two-cycle, crankcase compression engine. As is typical with outboard motor practice, the engine 12 is disposed so that the crankshaft, which rotates in a crankcase chamber 21, is disposed about a vertically extending axis. The crankcase chamber 21 is disposed at the forward end of the protective cowling and has, as is typical with two-cycle engine practice, individual crankcase chambers associated with each of the cylinders of the engine which are sealed from each other.

The engine 12 is provided with an induction and charge forming system, indicated generally by the reference numeral 22, which is comprised of a combined intake manifold reed valve assembly 23 that is affixed to the crankcase member 21 and contains induction passages and reed-type check valves for permitting a charge to flow from the induction system 22 into the individual sealed crankcase chambers for compression. The read-type check valves preclude reverse flow when the charge is being compressed, as is well known in this art.

A plurality of charge formers, in this illustrated prior art type of construction, three vertically spaced two-barrel carburetors 24*a*, 24*b*, and 24*c* supply a fuel-air charge to the runners of the manifold 23, with each throat or barrel of a carburetor serving a respective crankcase chamber.

An air inlet and silencing device, indicated generally by the reference numeral 25, is provided, and this comprises a generally longitudinally extending plenum chamber having outlet openings that communicate with the throats of each of the carburetors 24*a*, 24*b*, and 24*c*. This inlet device 25 has pairs of inlet openings 26*a*, 26*b*, and 26*c* which are aligned with the respective carburetors 24*a*, 24*b*, and 24*c*, and which induct the air from the interior of the protective cowling, as shown by the arrows in FIGS. 1 and 2.

Obviously, this type of arrangement, although it is designed to provide some silencing, cannot be very effectively tuned to silence particular engine speed ranges. In addition, this type of arrangement presents some risk that water may enter the rearwardly facing inlet openings 26*a*, *b*,*c*.

It is, therefore, a principal object of this invention to provide an improved air inlet and silencing device for an outboard motor.

It is a further object of this invention to provide an improved air silencing device for the charge formers of a marine propulsion unit that is contained within a protective cowling, but which can be provided with silencing devices that can be tuned.

It is a further object of this invention to provide an improved air inlet system for the protective cowling of an outboard motor wherein the air is introduced to the interior of the protective cowling in such a way that water is less likely to reach the charge formers and induction system of the engine.

SUMMARY OF THE INVENTION

A first feature of the invention is adapted to be embodied in a watercraft propulsion device that is comprised of an internal combustion engine having at least one charge former for delivering a fuel-air charge to the engine. A protective cowling encloses the engine, and an atmospheric air inlet is provided in the protective cowling for admitting air into the interior of the protective cowling. An air silencer is provided for receiving the air, silencing it, and delivering it to the charge former. The air silencer is comprised of an outer housing defining an air inlet disposed above the charge former, a delivery section extending from the air inlet to an inlet opening of the charge former, and a resonance chamber of a predetermined volume at one side of the charge former that communicates with the delivery section through a tuning neck.

Another feature of the invention is also adapted to be embodied in a watercraft propulsion device comprised of an internal combustion engine having at least one charge former for delivering a fuel air charge to the engine and a protective cowling enclosing the engine. An atmospheric air inlet is formed in an upper portion of the protective cowling for admitting atmospheric air to the interior of the protective cowling. An air silencer receives the air, silences it, and delivers it to the charge former. An air delivery duct is formed internally of the protective cowling and has an inlet opening communicating with the atmospheric air inlet and which duct extends downwardly and terminates at a downwardly disposed discharge opening positioned above the lower portion of the protective cowling so that any water that may be entrained in the inducted air will be directed away from the air inlet device of the engine.

DETAILED DESCRIPTION OF THE PREFERRED EMBODIMENT OF THE INVENTION

Figure 1:
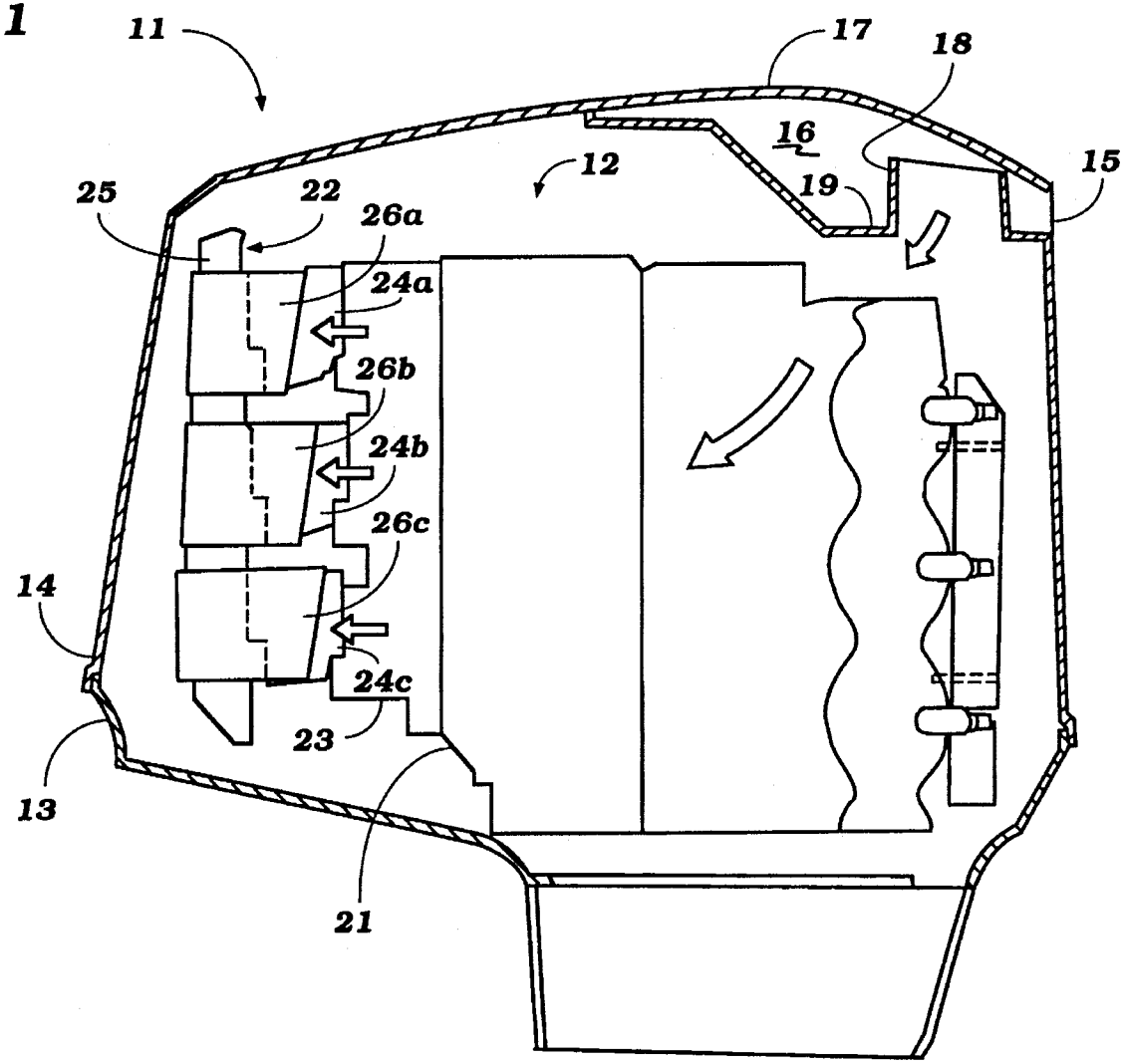
Figure 1 Prior Art
FIG. 1 is a side elevational view of the power head of a prior art type of construction of outboard motor with the protective cowling broken away and shown in cross section.
Figure 2:
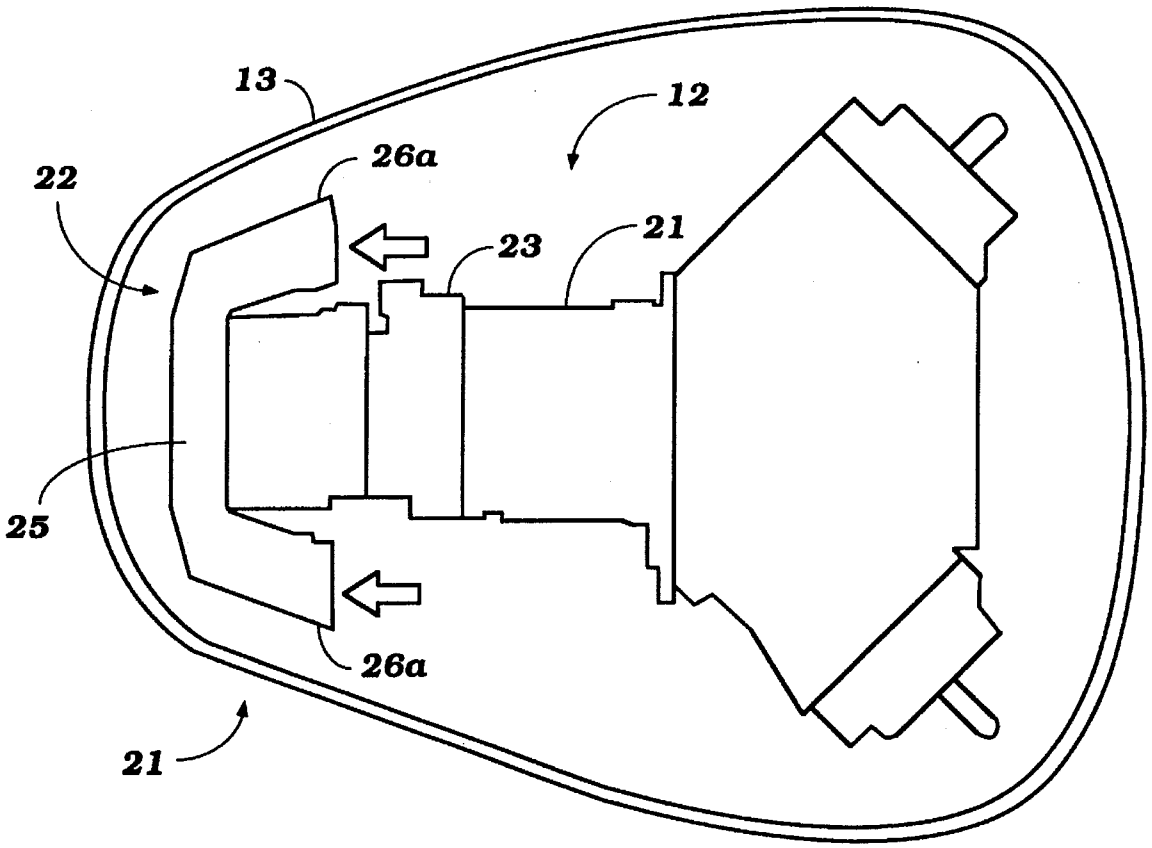
Figure 2 Prior Art
FIG. 2 is a top plan view of the prior art type of power head, with the upper main cowling member removed.

Referring now in detail to the drawings and initially to FIGS. 1 and 2, a power head of an outboard motor constructed in accordance with an embodiment of the invention is identified generally by the reference numeral 51. It is to be understood that the power head 51 may be employed with any type of propulsion device such as an outboard motor and drives any type of propulsion system normally employed in conjunction with watercraft.

The power head 51 includes a powering internal combustion engine 52 and a surrounding protective cowling, indicated generally by the reference numeral 53. This protective cowling 53 is comprised of a lower tray portion 54 that may be formed from a high-strength lightweight material such as aluminum or an aluminum alloy. A main cowling member 55 which is formed from a lighter weight material such as a molded fiberglass reinforced resin or the like is detachably affixed to the tray 54, and the cover 55 and tray 54 have interfitting flanges 56 so as to provide a neat and tight configuration. As with the prior art type of construction already described, the main cowling member 55 defines a rearwardly facing atmospheric air inlet opening 57 that communicates with a cavity 58 formed by a depressed portion 59 of the main cowling portion 55 and a cover piece 61 that is affixed thereto in a known manner. An air inlet opening 62 is formed by an upstanding neck 63 of the depressed portion 59 and draws air from the cavity 58 in the manner already described with the prior art type of constructions.

The engine 52 may be of any known type of construction and in the depicted embodiment comprises a V-6, two-cycle, crankcase compression, spark-ignited, internal combustion engine. It should be readily apparent to those skilled in the art how the invention can be employed with engines having other cylinder members and other configurations. In fact, the invention may also be employed in conjunction with rotary-type engines.

The engine 52 is comprised of a cylinder block 64 which is provided with a pair of angularly disposed cylinder banks, each of which forms three cylinder bores that extend with their axes lying in a horizontal plane. Cylinder heads 65 are affixed to the respective cylinder banks in a known manner and carry spark plugs 66 for firing the charge in the combustion chambers of the engine 52. Since the invention deals primarily with the induction system for the engine 52 and specifically the air introducing system, details of the internal construction of the engine are not necessary to understand the invention and will not be described.

A crankcase member 67 is affixed to the cylinder block 66 and defines the crankcase chamber in which the crankshaft of the engine rotates about a vertically disposed axis. As has been noted and as is typical with two-cycle engine practice, the crankcase is divided into a plurality of chambers each sealed from the other and each associated with a respective one of the cylinders in the cylinder banks of the cylinder block 64.

An induction system is provided for delivering a charge to the crankcase chambers, and this includes an intake manifold 68 containing reed-type check valves for permitting flow into the individual crankcase chambers and precluding reverse flow, as is well known in this art.

A plurality of charge formers, in the illustrated embodiment, three dual-barrel, side draft carburetors 69*a*, 69*b*, and 69*c* are affixed to the intake manifold 68 and form a fuel-air charge that is delivered to the engine through the induction system as thus far described. Although the invention is described in conjunction with dual-barrel side draft carburetors, it will be readily apparent to those skilled in the art that the invention can be employed with any type of charge forming system, including a fuel injection system, in which case the charge formers 69*a,b,c* will be throttle bodies with the fuel injection being introduced at anywhere in the system.

An air inlet and silencing device, indicated generally by the reference numeral 71, is provided for inducting the air from within the interior of the protective cowling 53, silencing it, and delivering it to the carburetors 69*a,b,c*. This air inlet device 71 will be described in detail by particular reference to FIGS. 5–7. The air inlet device is comprised of an outer housing 72 that consists of a pair of members 73 and 74 which are formed from any suitable material and which are detachably connected to each other.

This housing assembly 72 is affixed to each of the carburetors 69*a,b,c* by means of threaded fasteners 75 which pass through recesses 76 formed in the housing member 73 and are threaded into the upper portion of the air horns of the carburetors 69*a,b,c*. Gaskets 77 are interposed between the housing member 74 and the carburetors 69*a,b,c* to seal the area around the carburetor air inlet openings. The housing member 74 is provided with paired openings 78, each of which aligns with a respective one of the induction passages or barrels of the carburetors 69*a,b,c*.

Figure 3:
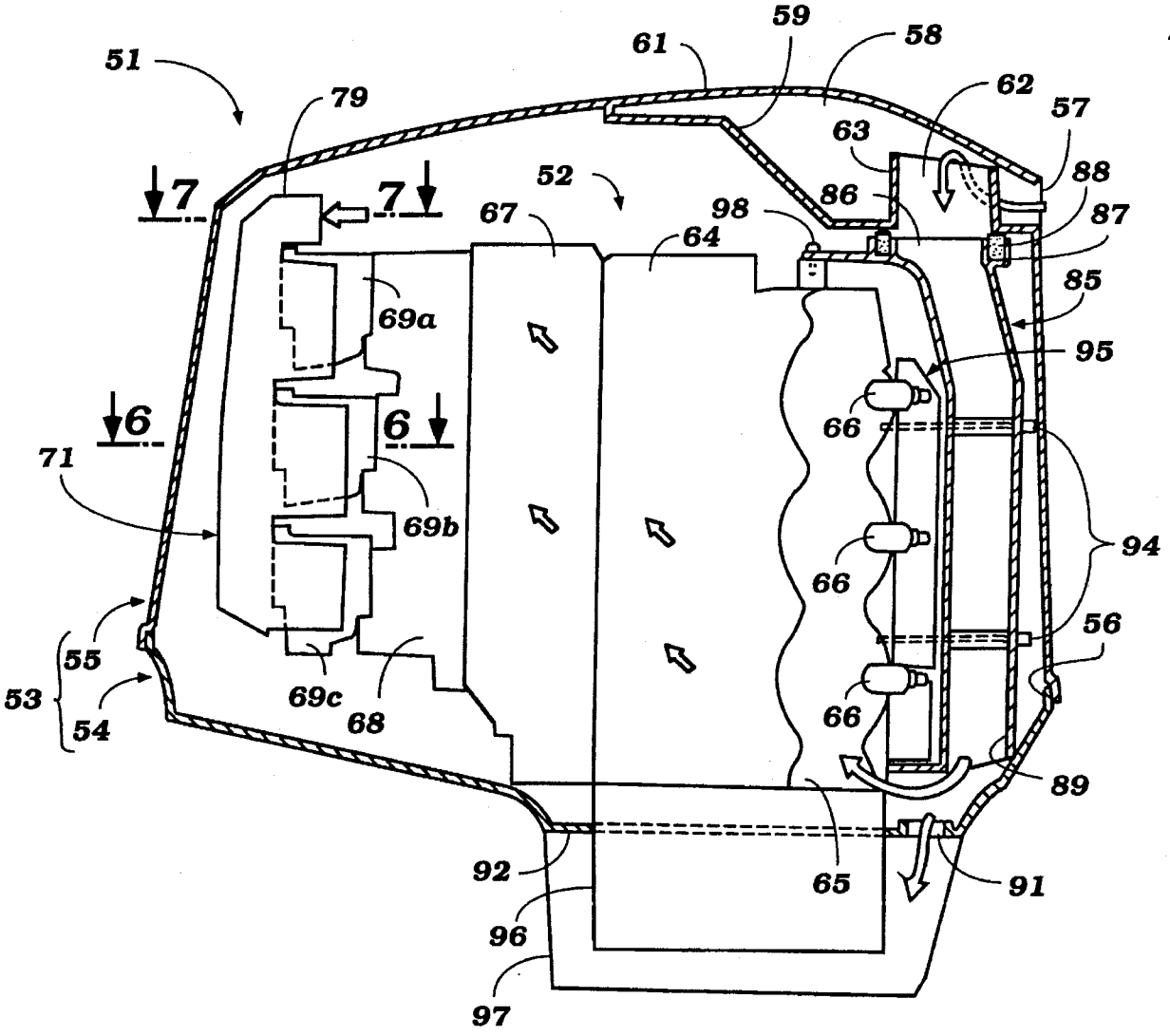
FIG. 3 is a side elevational view, with portions broken away and shown in section, in part similar to FIG. 1 and shows an embodiment of the invention.
Figure 5:
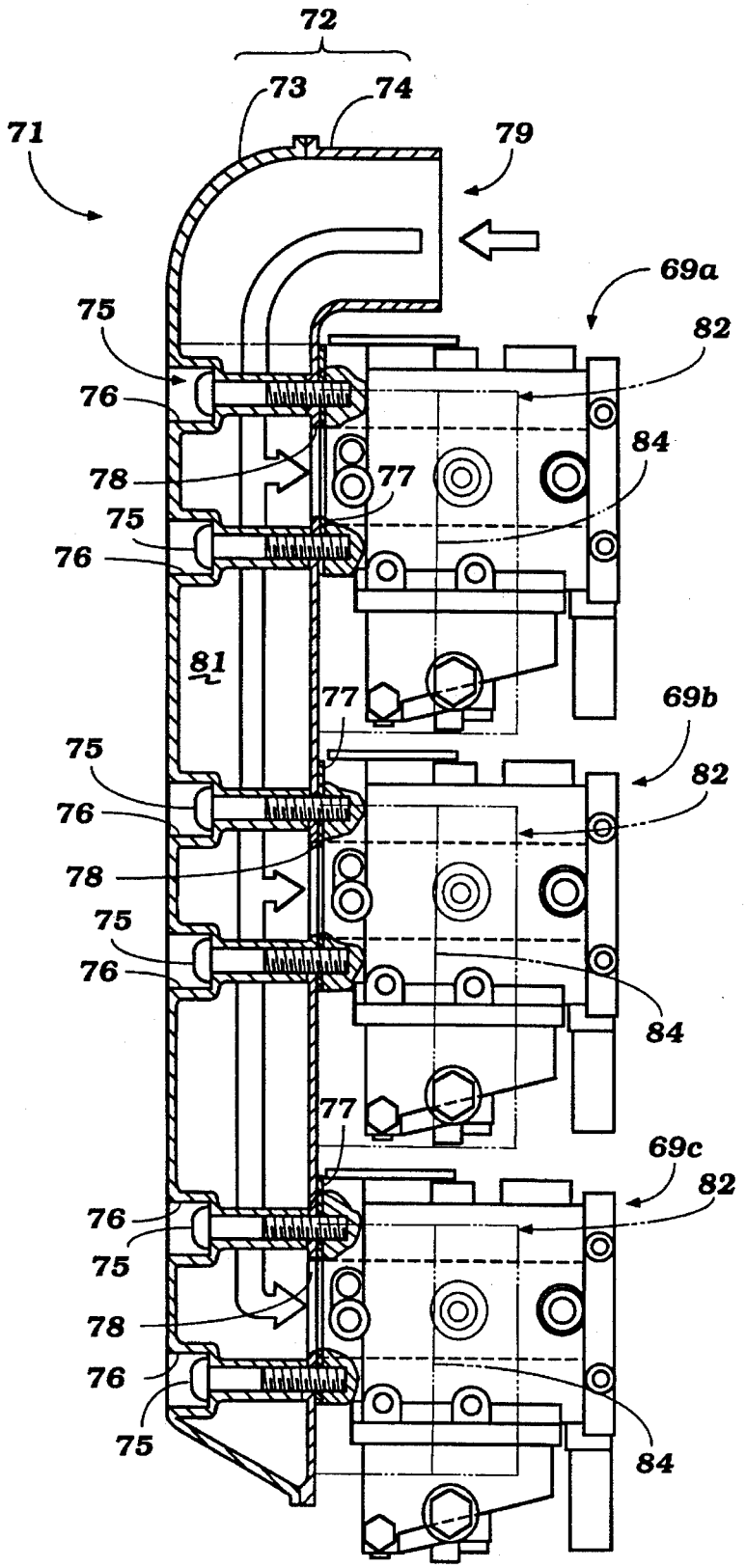
FIG. 5 is an enlarged cross-sectional view of the induction system and is taken generally along the line 5—5 of FIG. 4.
Figure 7:
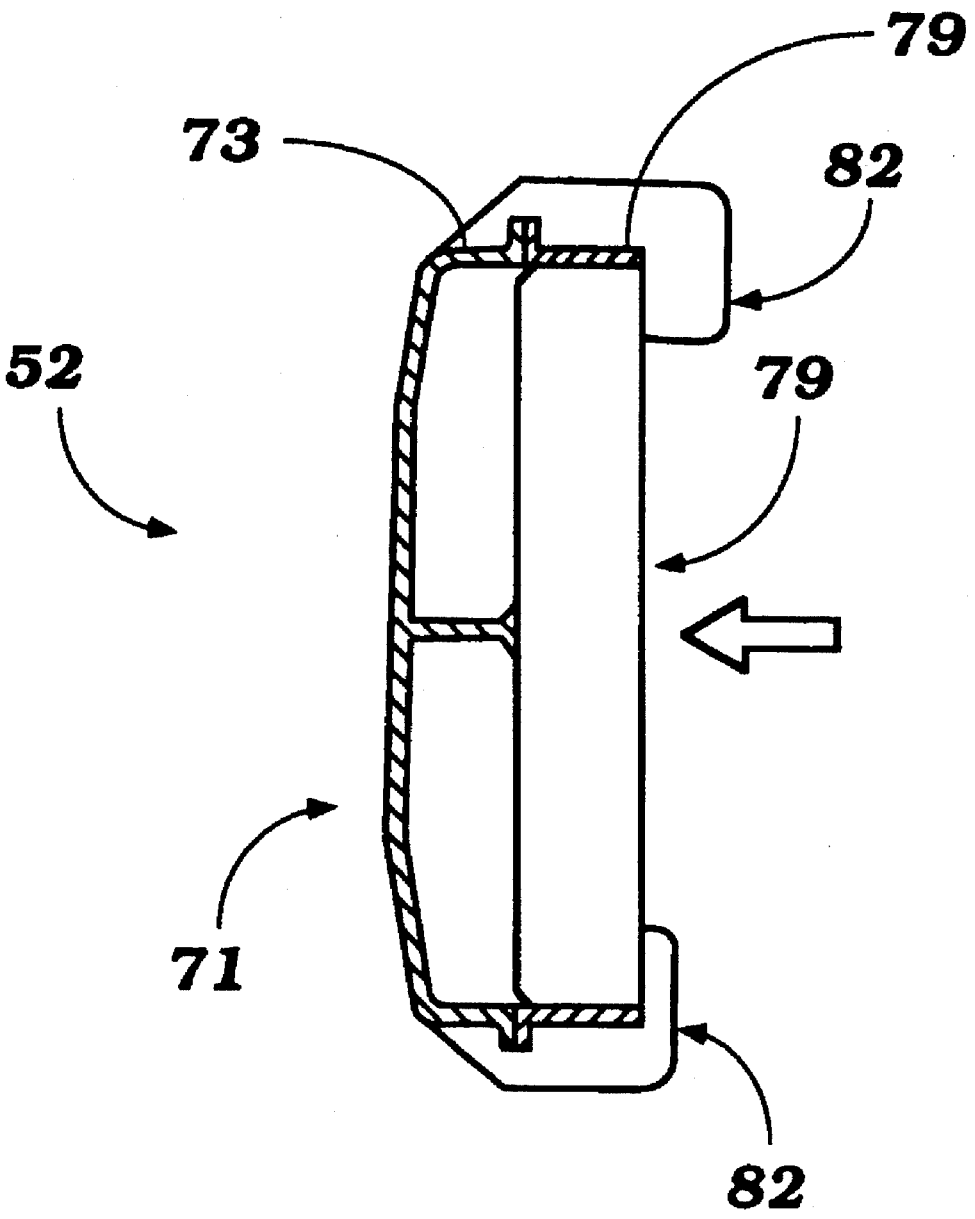
FIG. 7 is an enlarged cross-sectional view taken along the line 7—7 of FIG. 3.

The upper part of the housing 72 of the air inlet device 71 is formed with a rearwardly facing atmospheric air inlet opening 79, which appears best in FIGS. 5 and 7 and which faces rearwardly over the top of the engine 52, as shown in FIG. 3. This air then flows vertically downwardly through a delivery cavity 81 that extends vertically of the engine 52 and which extends to a point slightly below the air inlet opening of the lowermost carburetor 69. The flow of air into the air inlet device 71 is indicated by the arrows in the figures.

Figure 6:
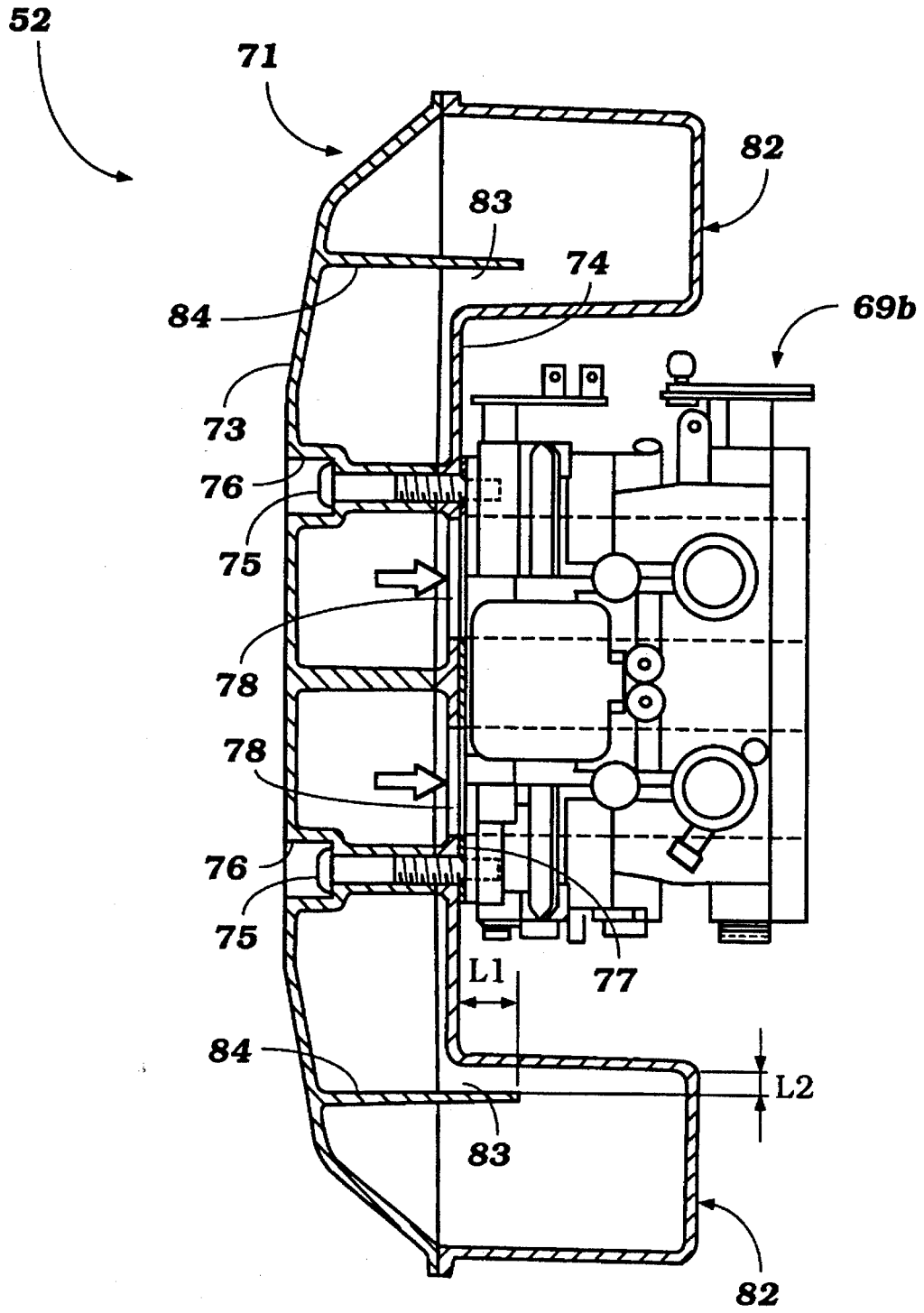
FIG. 6 is an enlarged cross-sectional view taken along the line 6—6 of FIG. 3.

A plurality of resonance chambers 82, one for each barrel of each carburetor in the illustrated embodiment, are provided on opposite sides of the carburetors 69*a,b,c*. These resonance chambers 82 have a predetermined volume V, as indicated in FIG. 6. These resonance chambers 82 communicate with the air delivery cavity 81 through respective tuning necks 83 (FIG. 6) that are defined by baffles 84 that extend from the cowling member portion 84 into the resonance chambers 82. These baffles 84 define a tuning neck that has a length L1 and a width L2, which is tuned relative to the volume V of the resonance chambers 82 so as to provide a Helmholtz resonator effect for tuning desired frequencies of sound.

Figure 8:
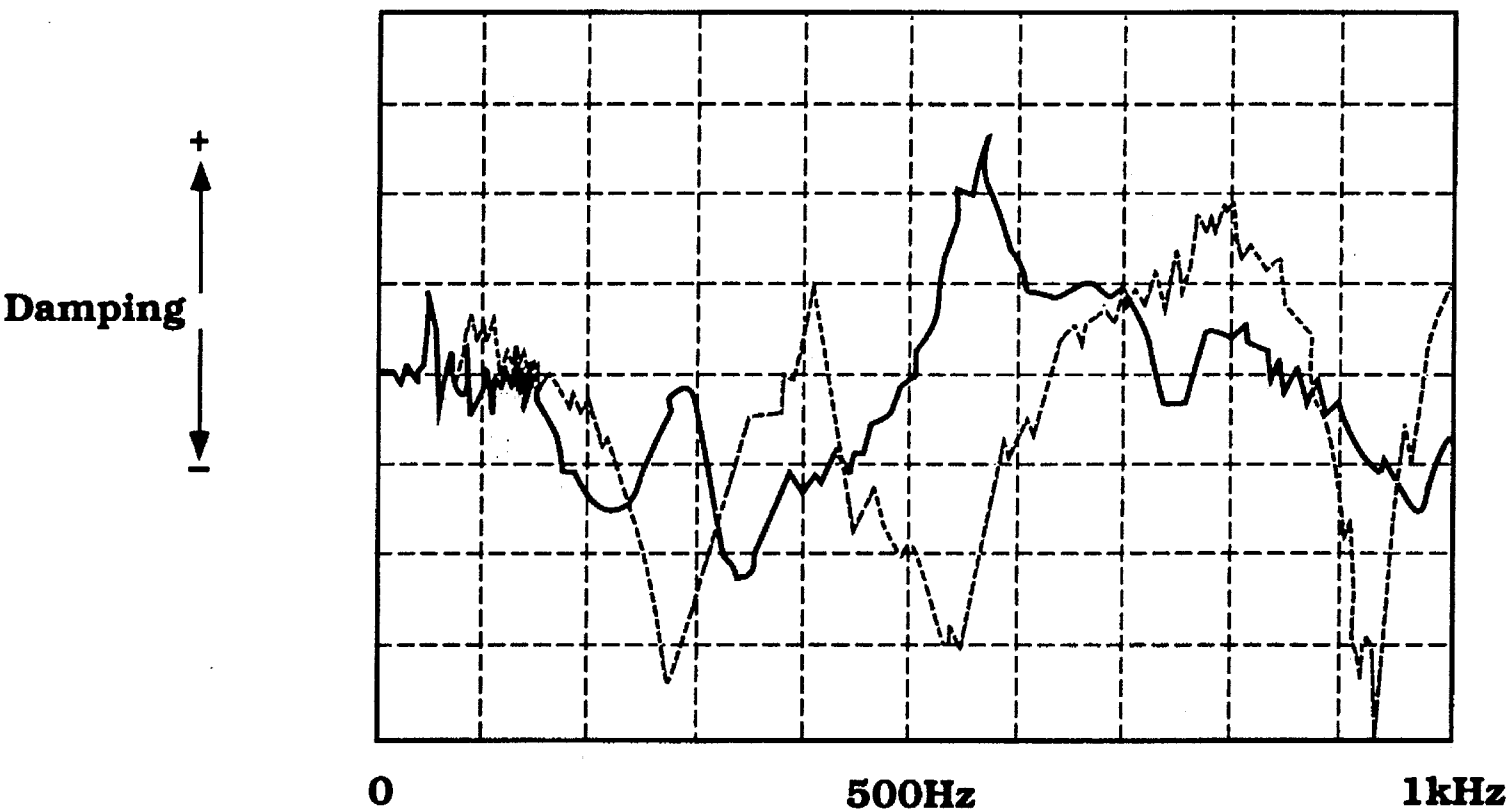
FIG. 8 is a graphical view showing the comparison of the silencing characteristics of this invention with those of the prior art type of constructions.

FIG. 8 is a graphical view showing the tuning effect of this embodiment, as shown in solid lines, with that of a conventional induction inlet device, as shown by broken lines. As a result, it can be seen that the silencing in a desired range, such as 500 Hz can be significantly improved. This construction permits tuning, unlike most conventional power head air inlet devices, even though the available space is quite small.

Figure 4:
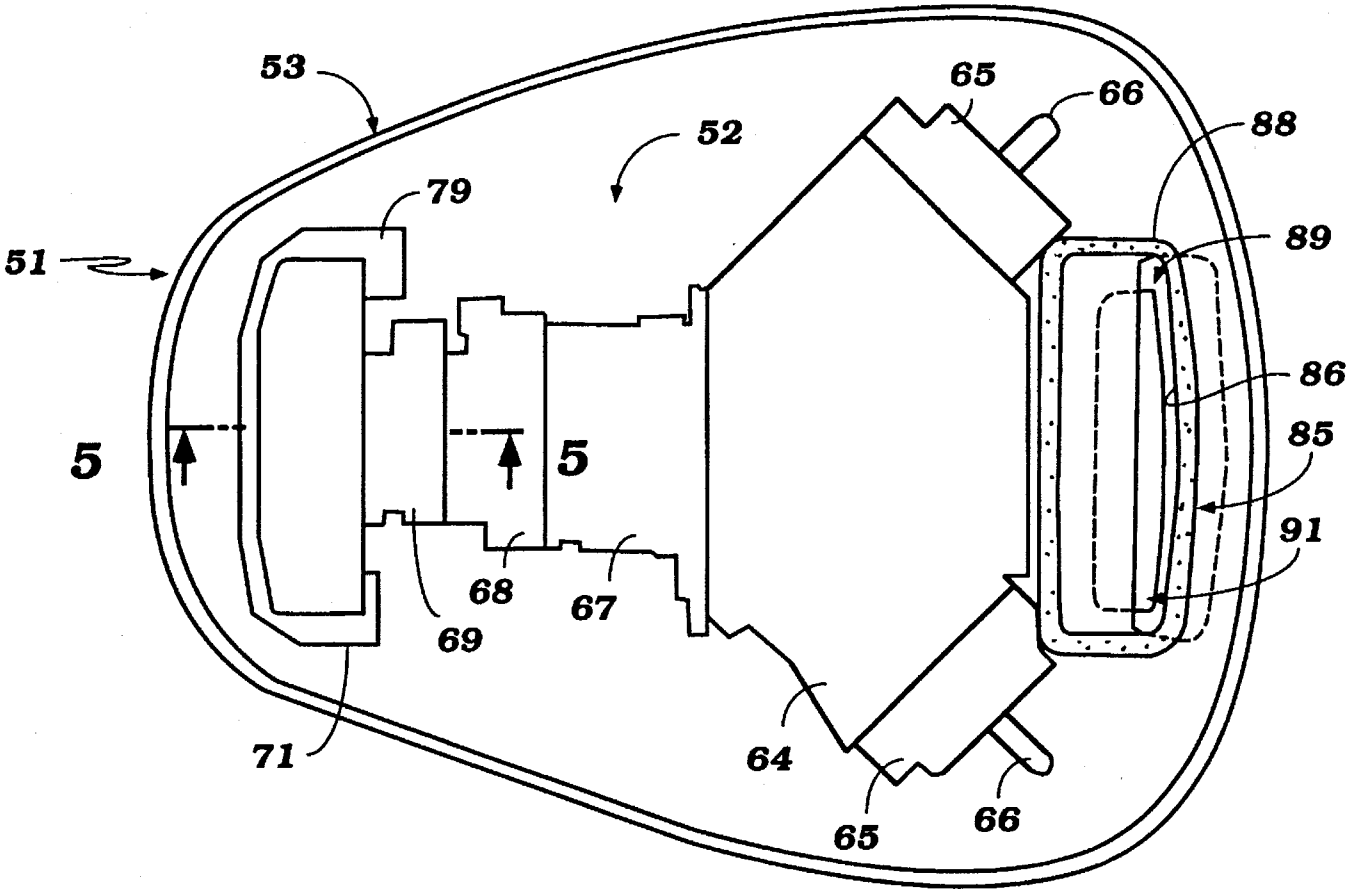
FIG. 4 is a top plan view, in part similar to FIG. 2, but showing the embodiment of the invention, also with the upper, main cowling portion removed.

As has been noted, the air inlet system in the protective cowling 53 is designed so as to attempt to exclude any water from entering the interior of the protective cowling. However, this is quite difficult, and in accordance with a feature of the invention, there is provided an internal duct 85 (FIGS. 3 and 4) within the interior of the protective cowling 53 that cooperates with the cowling atmospheric air inlet duct 62 to direct the intake air downwardly into the cowling assembly 53 and cause it to redirected so as to improve water separation and also so as to ensure that any water will be directed away from the air inlet opening 79 of the air silencing device 71.

The air inlet duct 85 has a generally rectangular cross section and is formed with an inlet opening 86 at its upper end that is surrounded by a channel-shaped flange 87. A gasket 88 is received in this flange and provides a sealing engagement with the underside of the main cowling member depressed portion 59 when the main cowling member portion 55 is attached to the tray 54. Hence, no air can escape directly into the interior of the protective cowling 53 without first passing through the duct 85.

The inlet opening 86 of the duct 85 is disposed above the upper end of the engine 52. The duct 85 has an outlet opening 89 formed at its lower end and which is juxtaposed to the lower end of the engine 52 and opens downwardly. Hence, air must flow as indicated in the direction of the arrows in FIG. 3 in order to enter the interior of the protective cowling 53.

A drain opening 91 is provided in the tray 54 and specifically in a horizontally extending portion 92 thereof so any water which may enter will flow by gravity and inertia out the drain opening 91. That is, when the air and water flow downwardly through the duct 85, it will be easy for the air to turn, but the water, being heavier, will be separated by inertia from the incoming air. The air must then flow upwardly to enter the air inlet opening 79 of the air inlet and silencing device 71 to ensure further against any water entering the engine through its induction system.

The duct 85 is affixed to the engine 52 and specifically to the cylinder block 64 by a fastener 93 that is threaded into a boss formed on the top of the cylinder block and a pair of fasteners 94 that extend into the valley area of the cylinder block. This duct-forming member 85 is juxtaposed to a spark box 95 that provides the control for the firing of the spark plugs 66. As a result, the cool air flowing through the duct 85 will at least partially cool the spark box 95.

The drain opening 91 in the lower tray portion 92 is juxtaposed to an exhaust guide 96 that is covered with an apron 97 and which receives the exhaust gases from the engine for downward discharge in a manner well known in this art.

It should be readily apparent from the foregoing description that the described cowling arrangement provides a very effective way in ensuring adequate air flow to the engine while ensuring complete water separation. In addition, the air inlet device provides good silencing and the ability to tune to dampen desired objectionable sound frequencies. Of course, the foregoing description is that of a preferred embodiment of the invention, and various changes and modifications may be made without departing from the spirit and scope of the invention as defined by the appended claims.

It is claimed:

1. A watercraft propulsion device comprised of an internal combustion engine having at least one charge former for delivering a fuel-air charge to said engine, a protective cowling enclosing said engine, an atmospheric air inlet in said protective cowling for admitting air into the interior of said protective cowling, and an air silencer for receiving said air, silencing said air, and delivering said air to said charge former, said air silencer being comprised of an outer housing defining an air inlet disposed above said charge former, a delivery section extending downwardly from said air inlet to an inlet opening of said charge former, a resonance chamber of predetermined volume at one side of said charge former, and a tuning neck connecting said resonance chamber with said delivery section.

2. A watercraft propulsion device as in claim 1, wherein there are resonance chambers and tuning necks at each side of the charge former, each communicating with the delivery section.

3. A watercraft propulsion device as in claim 1, wherein there are provided a plurality of charge formers, each served by the air silencer.

4. A watercraft propulsion device as in claim 3, wherein the charge formers are positioned one vertically above the other and wherein the air inlet is disposed above all of said charge former the associated engine.

5. A watercraft propulsion device as in claim 3, wherein there is provided at least one resonance chamber for each charge former.

6. A watercraft propulsion device as in claim 5, wherein the resonance chambers are separate from each other.

7. A watercraft propulsion device as in claim 6, wherein each resonance chamber communicates with the delivery section through a respective tuning neck.

8. A watercraft propulsion device as in claim 7, wherein there is provided a resonance chamber and tuning neck for each charge former on each side of each charge former.

9. A watercraft propulsion device as in claim 8, wherein the charge formers are positioned one vertically above the other and wherein the air inlet is disposed above the associated engine.

10. A watercraft propulsion device as in claim 9, further including an air inlet duct contained within the protective cowling and having an inlet opening communicating with the cowling air inlet and a discharge opening discharging at a point vertically beneath said inlet opening and at the lower end of said protective cowling.

11. A watercraft propulsion device as in claim 10, wherein the inlet duct is disposed at the end of the protective cowling opposite the end where the air silencer is positioned.

12. A watercraft propulsion device as in claim 11, wherein the inlet duct is affixed to the engine.

13. A watercraft propulsion device as in claim 12, wherein the lower portion of the protective cowling immediately adjacent the discharge end of the duct is provided with a drain opening for separating water from the air by gravity and inertia.

14. A watercraft propulsion device comprised of an internal combustion engine having at least one charge former for delivering a fuel-air charge to said engine, a protective cowling enclosing said engine, an atmospheric air inlet in an upper portion of said protective cowling for admitting air to the interior of said protective cowling, an air silencer for receiving air, silencing air, and delivering air to said charge former, and an air delivery duct formed internally of said protective cowling and having an inlet end in communication with said cowling air inlet and extending downwardly and terminating at a discharge opening positioned above a lower portion of said protective cowling.

15. A watercraft propulsion device as in claim 14, wherein the inlet duct is disposed at the end of the protective cowling opposite the end where the air silencer is positioned.

16. A watercraft propulsion device as in claim 15, wherein the inlet duct is affixed to the engine.

17. A watercraft propulsion device as in claim 16, wherein the lower portion of the protective cowling immediately adjacent the discharge end of the duct is provided with a drain opening for separating water from the air by gravity and inertia.

* * * * *